US008807458B2

(12) United States Patent
Al-Ansary

(10) Patent No.: US 8,807,458 B2
(45) Date of Patent: Aug. 19, 2014

(54) VORTEX-GENERATING NOZZLE-END RING

(75) Inventor: Hany Abdulrahman M. Al-Ansary, Riyadh (SA)

(73) Assignee: King Saud University, Riyadh (SA)

( * ) Notice: Subject to any disclaimer, the term of this patent is extended or adjusted under 35 U.S.C. 154(b) by 609 days.

(21) Appl. No.: 12/432,574

(22) Filed: Apr. 29, 2009

(65) Prior Publication Data

US 2010/0276517 A1 Nov. 4, 2010

(51) Int. Cl.

| | |
|---|---|
| ***B05B 1/26*** | (2006.01) |
| ***B05B 1/34*** | (2006.01) |
| ***B05B 1/14*** | (2006.01) |
| ***B05B 7/10*** | (2006.01) |

(52) U.S. Cl.

USPC ..... 239/505; 239/518; 239/461; 239/399; 137/808

(58) Field of Classification Search

CPC ..... B05B 1/26; B05B 1/34; B05B 1/14; B05B 7/10; B05B 1/262; B05B 1/3405; B63H 11/10; B64C 15/00; F15C 1/16; F04F 5/00; F04F 5/44; F02K 1/38; F02K 1/46; F02K 3/04; F02K 3/02

USPC ..... 137/808–813; 239/79–85, 461–524, 239/399–406

See application file for complete search history.

(56) References Cited

U.S. PATENT DOCUMENTS

| | | | | |
|---|---|---|---|---|
| 2,754,097 | A * | 7/1956 | Hjulian | 239/428.5 |
| 4,245,961 | A | 1/1981 | Bunting et al. | |
| 4,435,129 | A | 3/1984 | Mika et al. | |
| 4,749,336 | A | 6/1988 | Rojey | |
| 4,899,772 | A | 2/1990 | Rao | |
| 5,125,579 | A * | 6/1992 | Eggert | 239/439 |
| 5,344,079 | A * | 9/1994 | Tasaki et al. | 239/498 |
| 5,366,160 | A * | 11/1994 | Balderrama | 239/333 |
| 6,314,721 | B1 | 11/2001 | Mathews et al. | |
| 6,612,106 | B2 | 9/2003 | Balzer | |
| 6,718,752 | B2 | 4/2004 | Nesbitt et al. | |
| 6,854,260 | B2 * | 2/2005 | Anderson | 60/204 |
| 2008/0105487 | A1 | 5/2008 | Loheac et al. | |

OTHER PUBLICATIONS

Seiner et al.; "Mixing Enhancement by Tabs in Round Supersonic Jets"; Proceedings of the 4th AIAA/CEAS Aeroacoustics Conference; Toulouse, France; Jun. 2-4, 1998.

* cited by examiner

*Primary Examiner* — Justin Jonaitis

(74) *Attorney, Agent, or Firm* — Hart IP Law & Strategies

(57) ABSTRACT

A vortex-generating nozzle-end ring includes a body having an outer periphery and an aperture disposed through the body, the aperture defining an inner periphery of the body, the body being adaptable to the end of a nozzle, and at least one tab extending from the inner periphery radially inwardly toward the center of the aperture. In another embodiment, a nozzle includes a housing having a central longitudinal axis having an inlet and an outlet; a vortex-generating nozzle-end ring disposed on the outlet, including a body having an outer periphery and an aperture disposed through the body, the aperture defining an inner periphery of the body, the body being adaptable to the end of nozzle; and at least one tab extending from the inner periphery radially inwardly toward the center of the aperture.

21 Claims, 3 Drawing Sheets

VORTEX-GENERATING NOZZLE-END RING

BACKGROUND

Ejectors (also known as jet pumps, inductors, eductors, thermocompressors, and injectors) are widely used in a variety of engineering applications, such as desalination, refrigeration, and suction and evacuation of gases and fluids. Mixing enhancements of high and low speed streams is utilized as a means to improve efficiency of supersonic combustors, ejectors, nozzles, and the like. It is a well-known fact that the major mechanism for mixing these fluids and the like is turbulent mixing. It has been shown that the higher the turbulent intensity, the better the mixing process and the more secondary flow is entrained into the ejector. One method of improving turbulent mixing is by causing the flow coming out of the nozzle, for example, to swirl. Swirling the fluid flow creates streamline vortices that enhance turbulent mixing significantly.

One common method has been to place prism-shaped wedges into the stream of a nozzle to cause the fluid flowing therethrough to flow as a vortex, such as in a streamwise vorticity. Generally, these wedges extend inwardly in the fluid flow at the end of the nozzle. For example, it is well known in the art to place the wedges at the end of a nozzle by various methods, such as welding, wire EDM, or nozzle lip modification, making the wedges a permanent part of the nozzle. These methods are usually labor intensive and require skilled technicians, typically making them expensive.

SUMMARY

The above-described problems are solved and a technical advance achieved by the present vortex-generating nozzle-end ring. In general, the present vortex-generating nozzle-end ring is easy to attach to the end of a nozzle or replace a worn out vortex-generating nozzle-end ring already disposed on a nozzle end. The present vortex-generating nozzle-end ring alleviates the need to replace the entire nozzle. Additionally, the present vortex-generating nozzle-end ring is a convenient and available retrofitting solution to improve the performance of existing ejectors and suppress noise emanating from ejector nozzles.

In one embodiment, the present vortex-generating nozzle-end ring includes a body having an outer periphery and an aperture disposed through the body, the aperture defining an inner periphery of the body, the body being adaptable to the end of a nozzle. The body includes at least two tabs extending from the inner periphery radially inwardly toward the center of the aperture, a first tab of the at least two tabs being diametrically opposed to a second tab of the at least two tabs. Further, the body may be substantially planar-shaped and/or substantially planar ring-shaped. Additionally, the tabs may have a shape that tapers in shape as it extends towards the center of the aperture.

In one aspect, the at least two tabs may be selected from the group consisting of tapered prism-shaped, tapered pyramid-shaped, and tapered triangular prism-shaped, the apex of which extend substantially toward the center of the aperture. In another aspect, the vortex-generating nozzle-end ring may further include a flange extending axially from the outer periphery, the shoulder mountably adaptable for securing to the end of the nozzle. Further, the flange may include at least one of the group consisting of spot welds, rivets, fasteners, threadings, and compression fittings. In yet another aspect, the body may be made from a metal, alloy, or composite material. Also, the at least one tab occupies less than 30% of the area of the aperture.

In another embodiment, the present vortex-generating nozzle-end ring includes a substantially planar-ring body having an outer periphery and an inner periphery, the body being mountably adaptable to the end of a nozzle, and at least two tabs extending from the inner periphery radially inwardly toward the center of the aperture. In one aspect, each tab of the at least two tabs may have a shape that tapers in form as it extends towards the center of the aperture. In another aspect, each tab of the two tabs may be prism shaped, the apex of the prism extending substantially toward the center of the aperture. In yet another aspect, the vortex-generating nozzle-end ring may further include a flange circumscribing and extending axially from the outer periphery, the flange mountably adaptable for securing to the end of the nozzle. Additionally, the flange may further include at least one of the group consisting of spot welds, rivets, fasteners, threadings, and compression fittings.

In yet another embodiment, the present invention may include a nozzle including a housing having a central longitudinal axis having an inlet and an outlet; a vortex-generating nozzle-end ring disposed on the outlet, including a body having an outer periphery and an aperture disposed through the body, the aperture defining an inner periphery of the body, the body being detachably adaptable to the end of the nozzle; and at least two tabs extending from the inner periphery radially inwardly toward the center of the aperture. In another aspect, the body may be substantially planar-shaped and/or substantially planar ring-shaped. Also, each of the at least two tabs may have a shape that tapers in shape as it extends toward the center of the aperture.

Additionally, each of the at least two tabs may be selected from the group consisting of tapered prism-shaped, tapered pyramid-shaped, and tapered triangular prism-shaped, the apex of which extend substantially toward the center of the aperture. In another aspect, the vortex-generating nozzle-end ring may be attached to the outlet by at least one of the group consisting of spot welds, rivets, fasteners, threadings, adhesives, and compression fittings.

This Summary is provided to introduce a selection of concepts in a simplified form further described below in the detailed description. This Summary is not intended to identify key features or essential features of the claimed subject matter, nor is it intended to be used as an aid in determining the scope of the claimed subject matter. Additional features, advantages, and embodiments of the present vortex-generating nozzle-end ring are set forth or apparent from consideration of the following detailed description, drawings, and claims. Moreover, it is to be understood that both the foregoing Summary and the following detailed description are exemplary and intended to provide further explanation without limiting the scope of the present vortex-generating nozzle-end ring as claimed.

BRIEF DESCRIPTION OF THE DRAWINGS

For a more complete understanding of the features and advantages of the present vortex-generating nozzle-end ring, reference is now made to the detailed description of the vortex-generating nozzle-end ring along with the different figures referring to corresponding parts and in which.

DETAILED DESCRIPTION

While making and using various embodiments of the present vortex-generating nozzle-end ring are discussed in detail below, it should be appreciated that the vortex-generating nozzle-end ring provides many applicable inventive concepts which can be embodied in a wide variety of specific contexts. The specific embodiments discussed herein are merely illustrative of specific ways to make and use the invention and do not limit the scope of the present vortex-generating nozzle-end ring.

In the following description of the representative embodiments of the present vortex-generating nozzle-end ring, directional terms such as "above," "below," "upper," "lower," etc., are used for convenience in referring to the accompanying drawings. In general, "above," "upper," "upward," and similar terms refer to a direction that is commonly thought of as vertically upward; and the terms "below," "lower," "downward," and similar terms refer to a direction in the opposite direction or vertically downward as commonly known. For purposes of this discussion, the relativity of these terms may be thought of in the context of the use and operation of the present vortex-generating nozzle-end ring.

Figure 1:
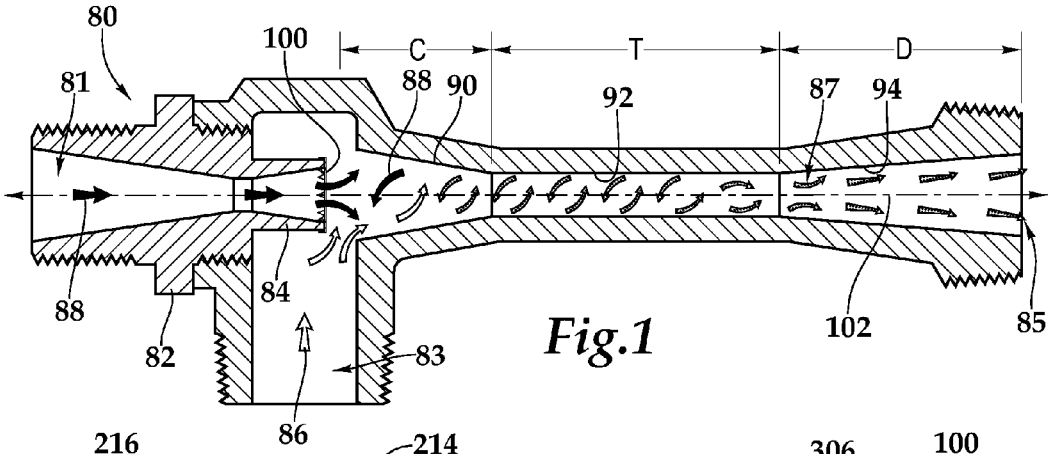
FIG. 1 illustrates a longitudinal cross-sectional view of an ejector with a vortex-generating nozzle-end ring on a nozzle according to one embodiment.

Referring initially to FIG. 1, an ejector having a vortex-generating nozzle-end ring 100 is illustrated and generally designated 80. Ejector 80 includes a housing 82 having a first inlet 81, a second inlet 83, and an outlet 85 that are in fluid communication with a longitudinal flow channel 87 including a chamber portion C, a throat portion T, and a diffuser portion D. In one embodiment, a flow of a primary fluid 88 enters inlet 81 of ejector 80 at a high pressure and temperature, and then expands to a very high speed and low pressure through converging-diverging nozzle 84. Low-pressure primary fluid 88 then passes by vortex-generating nozzle-end ring 100 as it exits the end of nozzle 84. As it exits nozzle 84, vortex-generating nozzle-end ring 100 causes primary fluid 88 to flow as a vortex having increased turbulent intensity. Primary fluid 88 having a vortex flow caused by vortex-generating nozzle-end ring 100 then exits nozzle 84 as a round jet and induces a flow of a secondary fluid 86 to be entrained into flow channel 87 of ejector 80. A longitudinal axis 102 runs through inlet 81, nozzle 84, vortex-generating nozzle-end ring 100, chamber portion C, throat portion T, diffuser portion D, and outlet 85.

Chamber portion C may have a converging funnel-shaped inner surface 90 that converges from a wider end located nearer to nozzle 84 and a narrower end located substantially adjacent to throat portion T. Additionally, an inner surface 92 of throat portion T may be a substantially cylindrical-shaped inner surface compared to 92. Preferably, diffuser portion D may have a diverging funnel-shaped inner surface 94 that diverges from a narrower end located nearer to inner surface 92 and a wider end that terminates substantially adjacent to outlet 85. The shapes of these inner surfaces may further facilitate the flow of secondary fluid 86 and primary fluid 88 through longitudinal axis 102 of flow channel 87.

As seen in FIG. 1, in one embodiment, the presence of a low pressure region in chamber portion C is due to the high speed of the jet emanating from nozzle 84 that instigates a secondary fluid 86 to be drawn into chamber portion C. The amount of flow of secondary fluid 86 entrained in chamber portion C depends upon the level of momentum transfer from primary fluid 88 to secondary fluid 86. Vortex-generating nozzle-end ring 100 enhances momentum transfer by allowing primary fluid 88 to have streamwise vortices on the outer periphery of the jet emanating from nozzle 84 such that the vortices are in direct contact with secondary fluid 86. These vortices will cause part of primary fluid 88 to move upwardly towards secondary fluid 86 while inducing secondary fluid 86 to move downwardly towards primary fluid 88 and the center of ejector 80, thereby enhancing the mixing process and allowing more secondary fluid 86 to be entrained into ejector 80.

Further, this process continues downstream of the first contact between primary fluid 88 and secondary fluid 86. As primary fluid 88 and secondary fluid 86 continue to mix, the vortices gradually diminish, indicating that the mixing process is nearing completion, which occurs generally near the end of throat portion T. Primary fluid 88 and secondary fluid 86, being completely mixed fluids, then enter the diffuser portion D where the pressure increases to a level that is somewhat lower than the original pressure of primary fluid 88 but also somewhat higher than the original pressure of secondary fluid 86. Therefore, the result of this process is an effective pumping of secondary fluid 86 through ejector 80.

Although one exemplary embodiment of an ejector 80 is described above, in another embodiment, vortex-generating nozzle-end ring 100 may be used with any nozzle types, whether with or without ejectors. For example, vortex-generating nozzle-end ring 100 may be used with other types of jet pumps to mix a wide range of fluids, including liquids and gases. Some exemplary pumps that may utilize vortex-generating nozzle-end ring 100 include injectors, exhausters, ejectors, siphons, eductors, boosters, and kinematic pumps. Some exemplary fields of use of vortex-generating nozzle-end ring 100 may include desalination plants, gas and vapor evacuation, and spray painting. Additionally, vortex-generating nozzle-end ring 100 may also be used with any thrusters, engines, motors, and the like. Some exemplary thrusters may be jet engines, such as that described with reference to FIG. 7.

Figure 2:
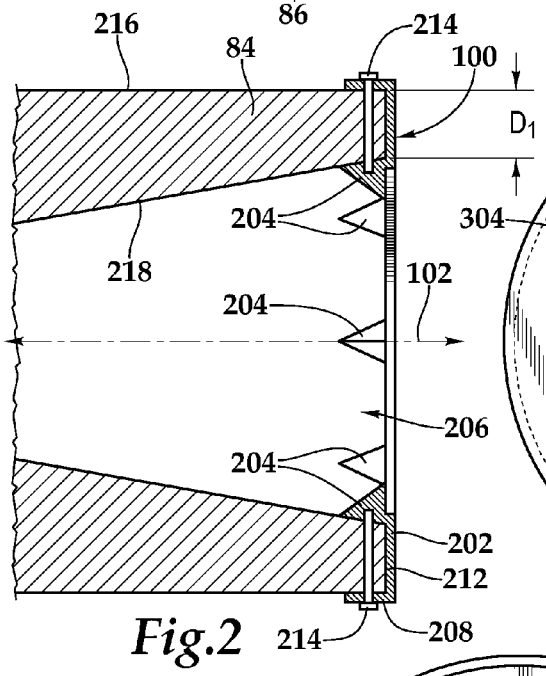
FIG. 2 illustrates a blown-up longitudinal cross-sectional view of a vortex-generating nozzle-end ring on a nozzle of FIG. 1 according to one embodiment.
Figure 6:
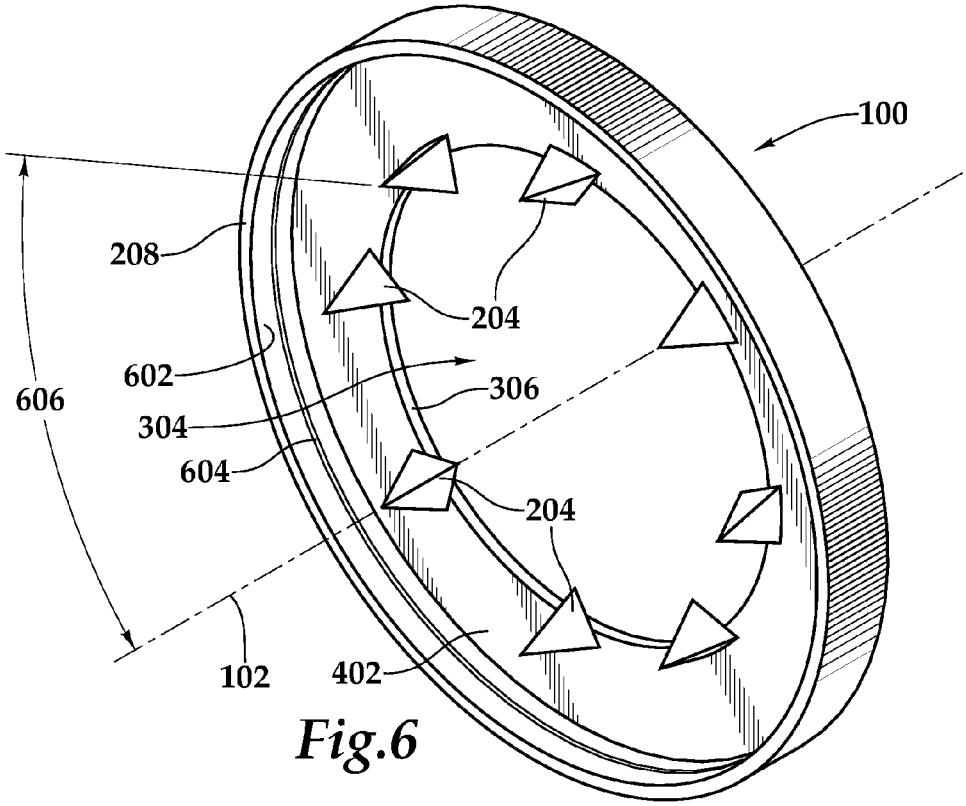
FIG. 6 illustrates a back perspective view of the vortex-generating nozzle-end ring of FIG. 1 showing an angle of inclination for a tab relative to a longitudinal axis according to one embodiment.

Referring now to FIG. 2, vortex-generating nozzle-end ring 100 can be seen disposed on an end 206 of nozzle 84. This cross-sectional view shows in one embodiment that vortex-generating nozzle-end ring 100 may have a substantially planar body 202 that extends substantially across the diameter of the end of nozzle 84. Body 202 may preferably include a flange 208 that extends from body 202 substantially along longitudinal axis 102 for engaging with an outer surface 216 of end 206 of nozzle 84. Generally, flange 208 further defines an outer periphery of vortex-generating nozzle-end ring 100 in one embodiment. Flange 208 may be secured to end 206 of nozzle 84 by use of a fastening means 214, such as spot welds, rivets, fasteners, threadings, adhesive, and/or compression fittings or ridges 604 (FIG. 6.). In one embodiment, a plurality of tabs 204, as further discussed below, includes a tapered side, as further discussed below, such that they are flush and conform to the tapered angle of inner surface 218 of nozzle 84 as best seen in FIG. 2.

As shown in FIG. 2, body 202 is substantially perpendicular to longitudinal axis 102 and further includes a plurality of tabs 204 that extend radially inwardly along longitudinal axis 102 of end 206 of nozzle 84. In one embodiment, tabs 204 may provide additional rigidity and support for vortex-generating nozzle-end ring 100 disposed on end 206 of nozzle 84 by engaging an inner surface 218 of nozzle 84. In this manner, a distance D1 is created between flange 208 and one inner surface of tabs 204. Preferably, distance D1 may be a constant or non-constant around vortex-generating nozzle-end ring 100. In one embodiment, each of tabs 204 is located the same distance D1 from flange 208. Similarly, a width W1 of the cross-section of end 206 of nozzle 84 is provided around the entire end 206 of nozzle 84. Preferably, distance D1 is approximately the same or slightly less than width W1 for providing a secure and tight fit of vortex-generating nozzle-end ring 100 to end 206 of nozzle 84. Additionally, end 206 of nozzle 84 may terminate in a substantially flat surface 212 that fits flushly against the inner surface 402 (FIG. 4) of body 202 for providing additional rigidity, support, and sealing functionality.

In another embodiment of vortex-generating nozzle-end ring 100, body 202 may not have a flange 208. In this embodiment, body 202 of vortex-generating nozzle-end ring 100 is directly secured to flat surface 212 of nozzle 84. As described herein, flat surface 212 of nozzle 84 and body 202 of vortex-generating nozzle-end ring 100 may be secured or joined together with rivets, spot welding, adhesive, fasteners, and the like.

Now referring to FIGS. 3-6, vortex-generating nozzle-end ring 100 is shown in various views. Further to that described above, preferably, body 202 may be a planar-shaped body; and more preferably, body 202 is planar ring-shaped. Although a substantially planar body form is shown for body 202, it may also have a shape or form that is non-planar in another embodiment. With further reference to these figures, vortex-generating nozzle-end ring 100 includes an aperture 304 that generally is defined by an inner periphery 306 that extends through body 202 of vortex-generating nozzle-end ring 100 for providing a passageway for fluid to flow through to be affected by tabs 204. In one embodiment, aperture 304 may be any size, surface area, or shape such that it provides a desired fluid flow therethrough. For example, although aperture 304 is shown with a circular area, it may have a shape of any desired polygonal cross-sectional shape such as to provide a desired fluid flow. Additionally, the size of aperture 304 determines the surface area of aperture 304 for flowing fluid, for example therethrough. The larger the size of aperture 304 the larger the surface area of its opening or orifice. In one aspect, the size of aperture 304 may be substantially the same size as of the opening or aperture of end 206 of nozzle 84 for desirable flow patterns to occur. In another aspect, the size of aperture 304 may be slightly less than the size of the opening or aperture of end 206 of nozzle 84 for desirable flow patterns to occur. Preferably, the size of aperture 304 may not be substantially smaller than the size of the opening or aperture of end 206 of nozzle 84, as this might produce undesirable flow patterns.

As shown in these figures, a portion of tabs 204 extend inwardly into aperture 304 from inner periphery 306 of body 202 of vortex-generating nozzle-end ring 100. Although eight tabs 204 are shown, any number of tabs 204 may be used with vortex-generating nozzle-end ring 100. For example, two tabs 204, four tabs 204, six tabs 204, etc. may be used. As the number of tabs 204 increases, the available surface area of aperture 304 will accordingly decrease. Thus, one skilled in the art would determine the number of tabs 204 of vortex-generating nozzle-end ring 100 with consideration given to the collective effects of tabs 204 on fluid flow through vortex-generating nozzle-end ring 100. Additionally, the type of matter, such as gas and liquid flowing through vortex-generating nozzle-end ring 100, may also be considered when determining the number of tabs 204 to use with a particular vortex-generating nozzle-end ring 100. Preferably, tabs 204 collectively occupy less than 30% of the surface area of aperture 304; more preferably, tabs 204 collectively occupy less than 15% of the surface area of aperture 304; and most preferably, tabs 204 collectively occupy less than 10% of the surface area of aperture 304.

As shown in FIGS. 3-6, the arrangement of tabs 204 substantially is symmetrical, meaning each tab 204 is diametrically opposed with another tab 204. In one embodiment, tabs 204 may be symmetrically disposed about inner periphery 306 of aperture 304 of body 202. In another embodiment, tabs 204 may be asymmetrically disposed about inner periphery 306 of aperture 304 of body 202. As further shown, a portion of tabs 204 is disposed on inner surface 402 of body 202 of vortex-generating nozzle-end ring 100. Preferably, the portion of tabs 204 that may be disposed on inner surface 402 of body 202 of vortex-generating nozzle-end ring 100 is substantially or relatively small so as to not interfere with the flow properties or patterns of a fluid, for example.

Figure 3:
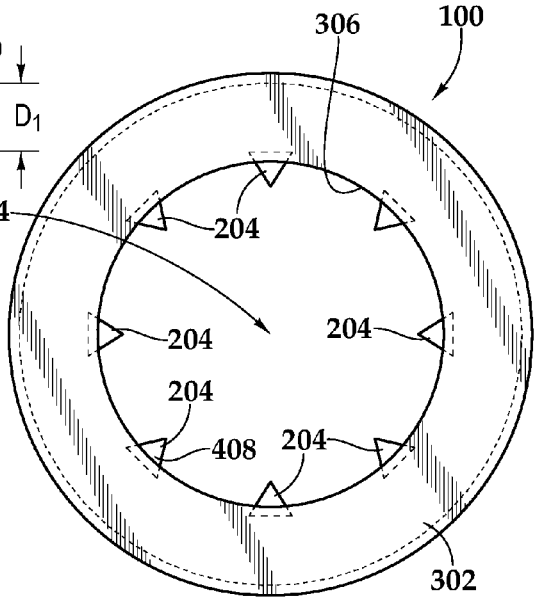
FIG. 3 illustrates a front view of the vortex-generating nozzle-end ring of FIG. 1 according to one embodiment.
Figure 4:
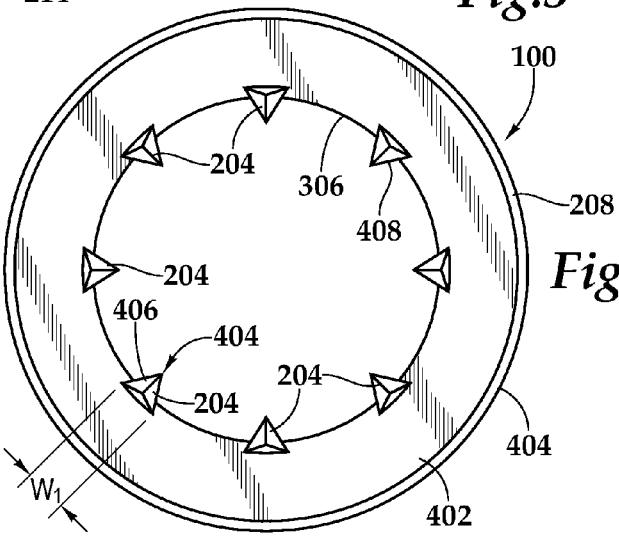
FIG. 4 illustrates a back perspective view of the vortex-generating nozzle-end ring of FIG. 1 according to one embodiment.
Figure 5:
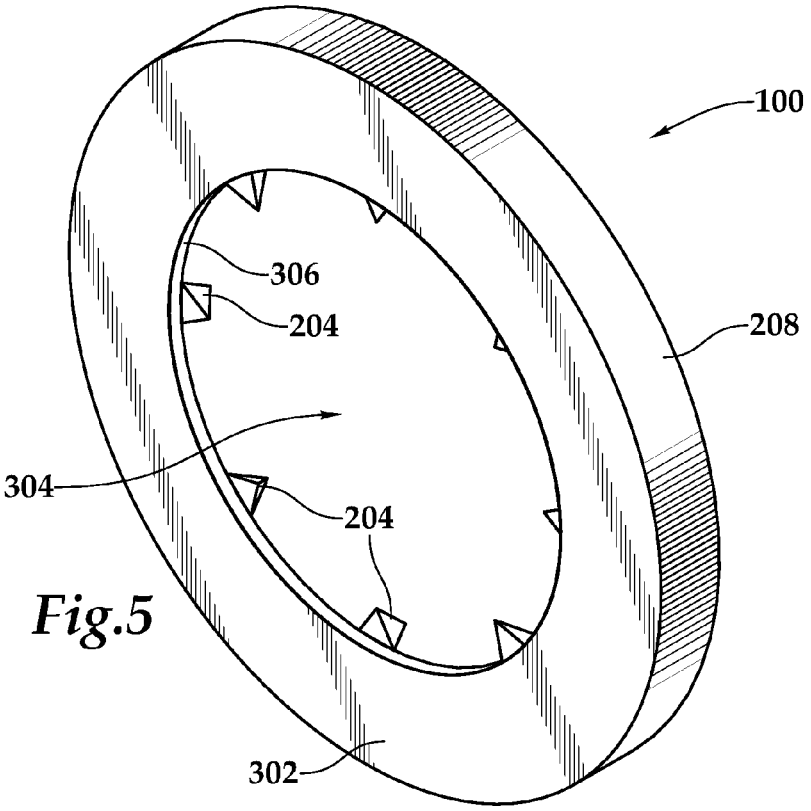
FIG. 5 illustrates a front perspective view of the vortex-generating nozzle-end ring of FIG. 1. according to one embodiment.

With particular reference to FIGS. 3 and 4, tabs 204 are shown having a generally tapered prism-shape formed by substantially triangular-shaped sides 406 such that each tab 204 has an apex 404 preferably located most inwardly into aperture 304. Additionally, tabs 204 include a base 408 made of one or more sides 406, for example. The base 408 of tabs 204 may be partially disposed on inner surface 402 of body 202 such that a portion of each base 408 may further form all or a portion of apex 404 of tabs 204. In another embodiment, tabs 204 may have any other shape or form conducive to providing a vortex flow of fluid. For example, the shape or form of tabs 204 may be tapered pyramid-shaped and/or tapered triangular prism-shaped. Additionally, base 408 of tabs 204 may be disposed at a slight angle relative to inner surface 402 such that it provides a vortex flow in a clockwise or counterclockwise direction relative to vortex-generating nozzle-end ring 100, for example.

Referring now to FIGS. 4 and 6, and in one embodiment, it can be seen that a portion of base 408 of tabs 204 that protrude into aperture 304 may be approximately perpendicular to longitudinal axis 102. Longitudinal axis 102 is shown relative to one tab 204 to show an angle of inclination 606 between the leading edge of tab 204 facing the flow of fluid through vortex-generating nozzle-end ring 100 and longitudinal axis 102. Angle of inclination 606 is shown between this leading edge of tab 204 and the longitudinal axis 102. In one embodiment, this angle of inclination 606 of tabs 204 relative to longitudinal axis 102 may be approximately 90°. In another embodiment, angle of inclination 606 may be from about 20° to about 90°. In yet another embodiment, angle of inclination 606 may be from about 30° to about 60°. In yet still yet another embodiment, angle of inclination 606 may be from about 35° to about 55°. In one aspect, angle of inclination 606 may be generally formed by two sides 406 of tabs 204, for example.

Body 202, tabs 204, and flange 208 may be made from a single unitary piece of material or made separately and then assembled into vortex-generating nozzle-end ring 100. If these elements are made separately, methods commonly known to those skilled in the art may be used to secure or assemble these elements together to form vortex-generating nozzle-end ring 100.

In addition, body 202, tabs 204, and flange 208 may be made from the same material or different materials in accordance with a particular application. Preferably, the materials are sufficiently rigid to be secured to end 206 of nozzle 84 and provide sufficient resistance to the fluid flowing through vortex-generating nozzle-end ring 100. For example, body 202, tabs 204, and flange 208 may be made from metals, alloys, or composites. Some exemplary metals include alkali metals, alkaline-earth metals, transition metals, noble metals, platinum metals, rare metals, rare-earth metals, actinide metals, light metals, and heavy metals. Some exemplary alloys include fusible alloys, eutectic alloys, alloy steel, stainless steel, and bronze. Vortex-generating nozzle-end ring 100 may further be fabricated or manufactured such as in a materials pressing, stamping, or casting manufacturing operation as known to those commonly skilled in the art.

Additionally, the thickness of body 202 and flange 208 may be any thickness desirable for a particular application. In one embodiment, the thickness of body 202 and flange 208 may be from about 0.05 mm to about 25 mm. Additionally, the diameter of body 202 and flange 208 may be any diameter desirable to fit a particular nozzle end as commonly known to those skilled in the art.

As described above, fastening means may be any type of fastening means commonly known in the art to facilitate quick and effective attachment to and detachment from ejectors, injectors, exhausters, ejectors, siphons, eductors, boosters, kinematic pumps, thrusters, engines, motors, and the like for particular uses. In one embodiment, the fastening means may be threads or compression fittings to provide easy interchangeability of vortex-generating nozzle-end ring 100 to another vortex-generating nozzle-end ring. For example, a particular vortex-generating nozzle-end ring 100 having a particular arrangement, pattern, number, shape, etc. of plurality of tabs 84 may be used on particular ejectors, injectors, exhausters, ejectors, siphons, eductors, boosters, kinematic pumps, thrusters, engines, motors, and the like for a particular use. Then, the vortex-generating nozzle-end ring 100 may be quickly interchanged with another vortex-generating nozzle-end ring having a different arrangement, pattern, number, shape, etc. of plurality of tabs 84 for use on the same or different ejectors, injectors, exhausters, ejectors, siphons, eductors, boosters, kinematic pumps, thrusters, engines, motors, and the like for a different use.

In one embodiment, vortex-generating nozzle-end ring 100 may be a plurality of vortex-generating nozzle-end rings, each having a different arrangement, pattern, number, shape, etc. of plurality of tabs 84, such that they may be quickly and easily interchanged with each other for providing different fluid vortexes for one or more devices, apparatuses, and/or applications.

Figure 7:
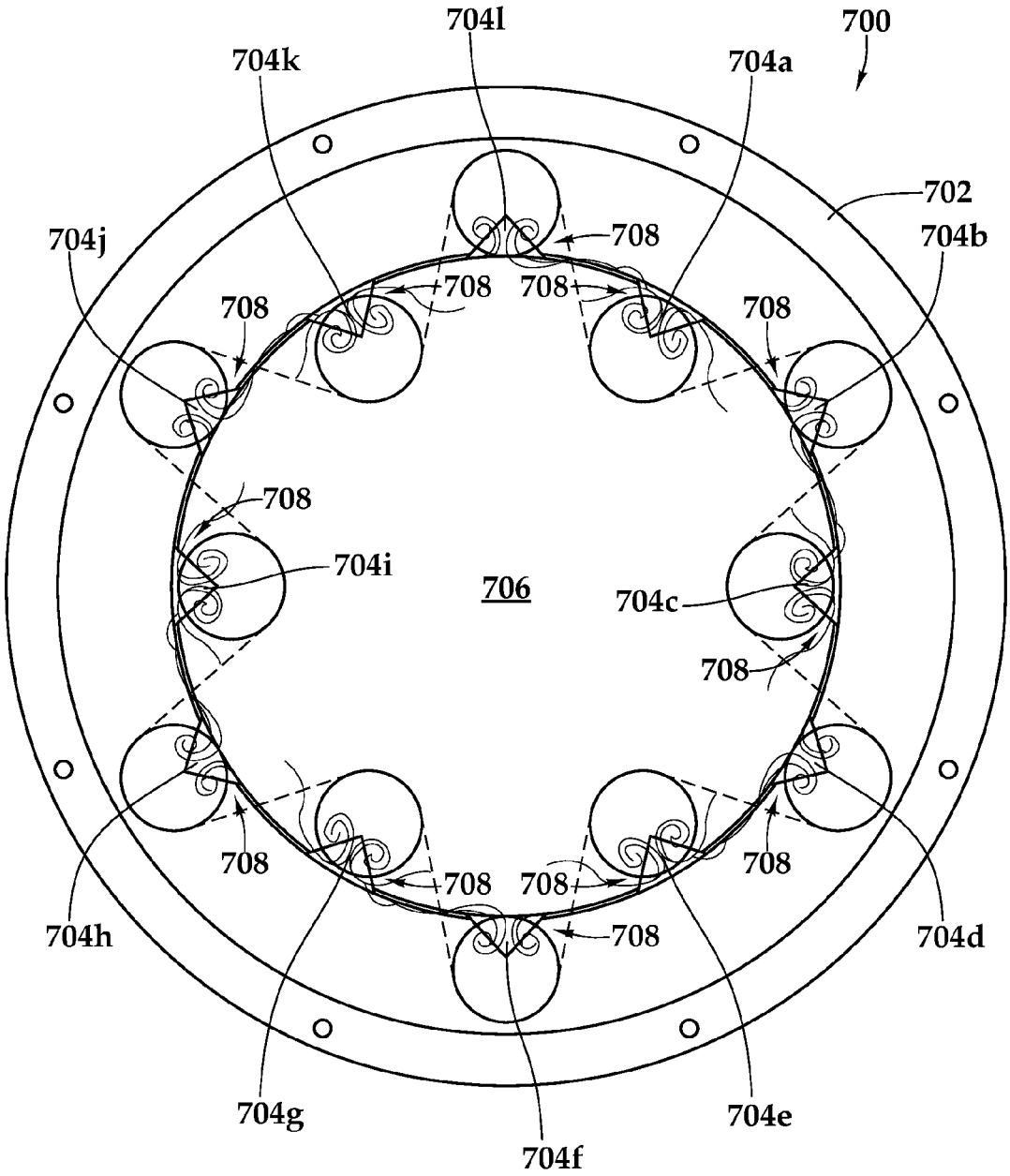
FIG. 7 illustrates a back perspective view of a jet engine thruster with a vortex-generating nozzle-end ring disposed on the rear end of the jet engine thruster according to one embodiment.

As described above, the present vortex-generating nozzle-end ring 100 may be used with any type of motors, engines, thrusters, ejectors, and the like. With reference now to FIG. 7, another embodiment of vortex-generating nozzle-end ring 700 is shown secured to the rear end of a jet engine thruster 702. In this embodiment, a plurality of tabs 704*a*-704*l* (collectively 704) is disposed about an aperture 706 or thruster opening of jet engine thruster 702. In an alternating arrangement, tabs 704 extend inwardly and outwardly relative to aperture 706 for producing desired vortices 708 exiting jet engine thruster 702. In this embodiment, tabs 704*a*, 704*c*, 704*e*, 704*g*, 704*i*, and 704*k* may extend inwardly towards aperture 706 while tabs 704*b*, 704*d*, 704*f*, 704*h*, 704*j*, and 704*l* may extend outwardly away from aperture 706. In another embodiment, tabs 704 may all extend outwardly relative to aperture 706. In yet another embodiment, tabs 704 may all extend inwardly relative to aperture 706.

Conclusion

The above-described exemplary embodiments of the vortex-generating nozzle-end ring are presented for illustrative purposes only. While the vortex-generating nozzle-end ring is satisfied by embodiments in many different forms, it is understood that the present disclosure is to be considered as exemplary and is not intended to limit the described systems and methods to the specific embodiments illustrated and described herein. Numerous variations may be made by persons skilled in the art without departure from the spirit of this description. Moreover, features described in connection with one embodiment may be used in conjunction with other embodiments, even if not explicitly stated above. The scope of the vortex-generating nozzle-end ring will be measured by the appended claims and their equivalents. The abstract and the title are not to be construed as limiting the scope of the claims, as their purpose is to enable the appropriate authorities, as well as the general public, to quickly determine the general nature of the described vortex-generating nozzle-end ring. In the claims that follow, unless the term "means" is used, none of the features or elements recited therein should be construed as means-plus-function limitations pursuant to 35 U.S.C. §112, ¶6.

The invention claimed is:

1. A vortex-generating nozzle-end ring comprising:

a replaceable vortex-generating nozzle-end ring to enhance mixing of liquids or gases in a pump, the replaceable vortex-generating nozzle-end ring including:

a body having an outer periphery and an aperture disposed through the body, the aperture defining an inner periphery of the body, the aperture being a polygonal cross-sectional shape, the body being adaptable to the end of a nozzle to cause low pressure fluid entering the nozzle to exit out of the nozzle to flow as a vortex swirl with increased and high turbulent intensity, the vortex swirl, created by the body, having streamwise vortices on an outer periphery of the jet emanating from the nozzle; and at least two tabs extending from the inner periphery radially inwardly toward the center of the aperture, a first tab of the at least two tabs being diametrically opposed to a second tab of the at least two tabs, each tab of the at least two tabs being non-porous and having a solid surface;

wherein each tab of the at least two tabs is selected from the group consisting of tapered prism-shaped, tapered pyramid-shaped, and tapered triangular prism-shaped, the apex of which extend substantially toward the center of the aperture.

2. The vortex-generating nozzle-end ring of claim 1, wherein the body is substantially planar-shaped.

3. The vortex-generating nozzle-end ring of claim 1, wherein the body is substantially planar ring-shaped.

4. The vortex-generating nozzle-end ring of claim 1, wherein each tab of the at least two tabs has a shape that tapers in shape as it extends towards the center of the aperture.

5. The vortex-generating nozzle-end ring of claim 1, further comprising:

a flange extending axially from the outer periphery, the flange mountably adaptable for securing to the end of the nozzle.

6. The vortex-generating nozzle-end ring of claim 5, wherein the flange further comprises:

at least one of the group consisting of spot welds, rivets, fasteners, threadings, and compression fittings.

7. The vortex-generating nozzle-end ring of claim 1, wherein the body is made from a metal, alloy, or composite material.

8. The vortex-generating nozzle-end ring of claim 1, wherein the at least two tabs occupies less than 30% of the area of the aperture.

9. The vortex-generating nozzle-end ring of claim 1, further comprising:

wherein the replaceable vortex-generating ring is configured to allow installation into an ejector, each tab of the at least two tabs being diametrically and symmetrically opposed to the second tab of the at least two tabs, each tab causing a primary fluid to exit the nozzle as a round jet to induce a flow of a secondary fluid to be entrained into a flow channel of the ejector.

10. The vortex-generating nozzle-end ring of claim 1, further comprising:

wherein the replaceable vortex-generating ring is configured to allow installation in a thruster opening of a jet engine, each tab of the at least two tabs being diametrically: (a) opposed to the second tab of the at least two tabs, each tab extending inwardly relative to the aperture; or (b) opposed to the second tab of the at least two tabs, each tab extending outwardly relative to the aperture.

11. The vortex-generating nozzle-end ring of claim 1, wherein the at least two tabs occupy less than 15% of the area of the aperture.

12. The vortex-generating nozzle-end ring of claim 1, wherein a base of the at least two tabs is disposed at an angle relative to an inner surface to provide a vortex flow in a counterclockwise direction.

13. An apparatus comprising:

a vortex-generating nozzle-end ring including:

a substantially planar-ring body having an outer periphery and an inner periphery, the body being mountably adaptable to the end of a nozzle to cause low pressure fluid entering the nozzle to exit out of the nozzle to flow as a vortex swirl with increased and high turbulent intensity, the vortex swirl, created by the body, having streamwise vortices on an outer periphery of the jet of fluid or gas emanating from the nozzle; and at least two solid non-porous tabs extending from the inner periphery radially inwardly toward or outwardly away from the center of the aperture, each tab of the at least two tabs being diametrically opposed to the other tab of the at least two tabs;

wherein each tab of the at least two tabs is selected from the group consisting of tapered prism-shaped, tapered pyramid-shaped, and tapered triangular prism-shaped, the apex of which extend substantially toward the center of the aperture.

14. The apparatus of claim 13, wherein each tab of the at least two tabs has a shape that tapers in form as it extends with respect to the center of the aperture.

15. The apparatus of claim 13, further comprising:

a flange circumscribing and extending axially from the outer periphery, the flange mountably adaptable for securing to the end of the nozzle.

16. The apparatus of claim 15, wherein the flange further comprises:

at least one of the group consisting of spot welds, rivets, fasteners, threadings, and compression fittings.

17. A vortex nozzle to enhance mixing, the vortex nozzle comprising:

a housing having a central longitudinal axis, the housing having an inlet and an outlet; and a vortex-generating nozzle-end ring disposed on the outlet to enhance mixing of liquids or gases in a pump, the vortex-generating nozzle-end ring comprising:

a body having an outer periphery and an aperture disposed through the body, the aperture defining an inner periphery of the body, the aperture being a polygonal cross-sectional shape, the body being detachably adaptable to the end of the nozzle to cause low pressure fluid entering the nozzle to exit out of the nozzle to flow as a vortex swirl with increased and high turbulent intensity, the vortex swirl, created by the body, having streamwise vortices on an outer periphery of the jet emanating from the nozzle; and at least two tabs extending from the inner periphery radially inwardly toward the center of the aperture, each of the at least two tabs being non-porous, a first tab of the at least two tabs being diametrically opposed to a second tab of the at least two tabs;

wherein each tab of the at least two tabs is selected from the group consisting of tapered prism-shaped, tapered pyramid-shaped, and tapered triangular prism-shaped, the apex of which extend substantially toward the center of the aperture.

18. The vortex nozzle of claim 17, wherein the body is substantially planar-shaped.

19. The vortex nozzle of claim 7, wherein the body is substantially planar ring-shaped.

20. The vortex nozzle of claim 17, wherein each tab of the at least two tabs has a shape that tapers in shape as it extends towards the center of the aperture.

21. The vortex nozzle of claim 17, wherein the vortex-generating nozzle-end ring is attached to the outlet by at least one of the group consisting of spot welds, rivets, fasteners, threadings, and compression fittings.

* * * * *